United States Patent [19]

Thompson

[11] Patent Number: 4,998,350

[45] Date of Patent: Mar. 12, 1991

[54] KNIFE AND SHEATH

[76] Inventor: Lynn C. Thompson, 987 Sand Piper Ct., Ventura, Calif. 93001

[21] Appl. No.: 446,120

[22] Filed: Dec. 5, 1989

[51] Int. Cl.[5] ..... B26B 29/02

[52] U.S. Cl. ..... 30/151; 224/232

[58] Field of Search ..... 30/143, 151, 164; 7/167; 224/232

[56] References Cited

U.S. PATENT DOCUMENTS 675,118 5/1901 Sweet ..... 224/232

*Primary Examiner*—Douglas D. Watts

*Attorney, Agent, or Firm*—Marvin E. Jacobs

[57] ABSTRACT

A molded plastic sheath that fits over a knife blade, relieved on one side with slots so as to nearly detach a portion of the sheath to form a locking lever with a pin at one end that engages a hole in the knife blade. Pressing the opposite end of the lever rocks the lever on the blade and withdraws the pin from the hole permitting separation of the knife and sheath.

5 Claims, 1 Drawing Sheet

KNIFE AND SHEATH

DESCRIPTION

1. Technical Field

This invention relates to sheaths for knives and more particularly for a combination sheath and knife wherein the sheath is both reliably secure and easily removable.

2. Background of the Invention

Knives, being sharp and dangerous are best stored and carried in a suitable sheath structure which may cover the whole knife, the blade alone, or any combination of the blade and grip. For the best safety, it is desirable that the sheath remain securely in place over at least the sharp blade portion even during rough handling, abuse, or negligent treatment of the knife.

Numerous prior art approaches to this problem will be familiar to those skilled in the art including leather and plastic structures designed to surround or slide over the blade to prevent accidental contact therewith. Such sheath structures are typically retained in place by a strap connection behind the handle guard or perhaps some type of snap connector that engages the handle. Prior art sheath retaining devices, if suitably secure, can be difficult to undo and remove. The present invention is directed toward this problem, providing a structure that is both easy to remove and strongly mounted on the knife when the knife is not in use.

1. Summary of the Invention

Briefly, the knife sheath of my invention is formed from a single integrated piece of plastic material with a pocket sized to accept the blade of the knife snugly therein. Openings are formed in the plastic material on one side of the sheath so as to free up a portion of the plastic material in the central area of the sheath. This free portion remains connected to the main sheath material by a pair of hinge members that extend from the free portion to the main body of the sheath. The free portion then forms a lever that can pivot about the hinges utilizing the natural elasticity of the plastic in the hinge to provide a torsional restoring force that, in the absence of a disturbing force, holds one end of the lever against the knife blade. The end of the lever that springs against the blade includes a small locking pin that protrudes into a hole in the knife blade. The locking pin prevents the sheath from sliding off the blade during storage or transport of the sheathed knife. However, for quick and easy removal of the sheath, the user need only press down on the other end of the lever, rocking it on the face of the blade and about the hinges so as to raise the locking pin out of the hole in the blade. The knife can now be easily withdrawn.

Simple, efficient, and compact structure is therefore provided to enclose and shield the knife blade that can be quickly and conveniently removed with the pressure of a finger in the correct location. The locking pivot lever falls easily to hand in use because the natural hand position used to withdraw the sheath would likewise place the thumb or forefinger directly on the sheath body at the position occupied by the release lever. The bulk of an additional connector or fastener that must travel over and about the guard and handle is avoided thus making the overall package smaller. Further, since the sheath surrounds just the blade and locks into a hole in the blade, it has no edges or parts that are exposed beyond the physical boundaries of the guard and handle. Such exposed edges are easily caught on foreign objects during handling of the sheathed knife causing the sheath to be unintentionally pulled or pried off of the knife.

Additional advantages and benefits will become apparent upon consideration of the following detailed description and drawings.

DETAILED DESCRIPTION OF THE INVENTION

Figure 5:
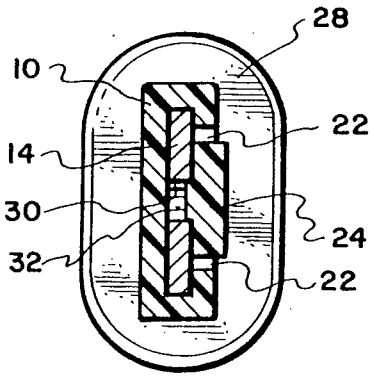
FIG. 5 is another cross-sectional view taken farther along the knife at line 5—5 in FIG. 1 to better show how the release lever is unconnected from the main sheath body in this area and also detailing the locking pin structure.
Figure 4:
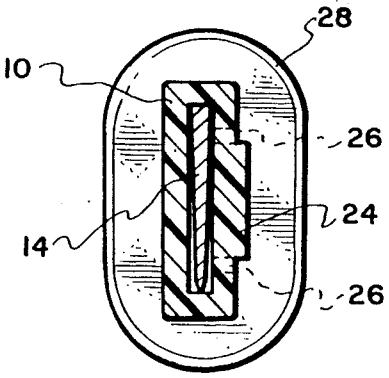
FIG. 4 is a cross-sectional view taken on line 4—4 in FIG. 1 that shows how the pivoting release lever connects to the outer main body of the sheath near its central area.
Figure 1:
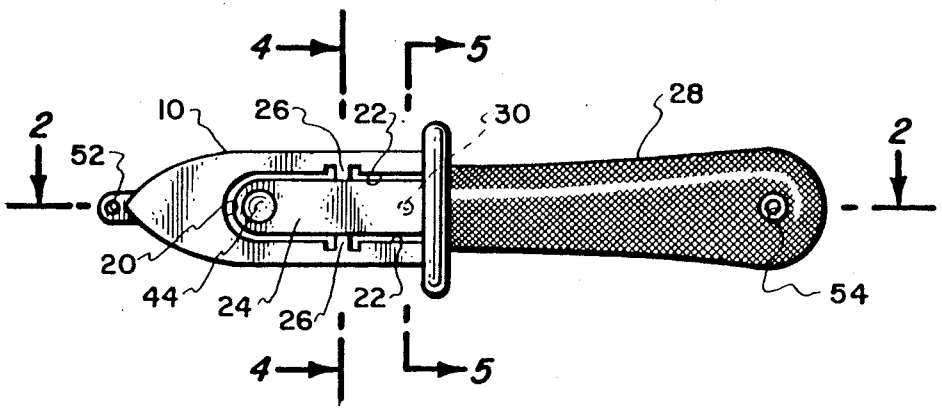
FIG. 1 shows an elevational view of the sheath and knife combination of the present invention.
Figure 3:
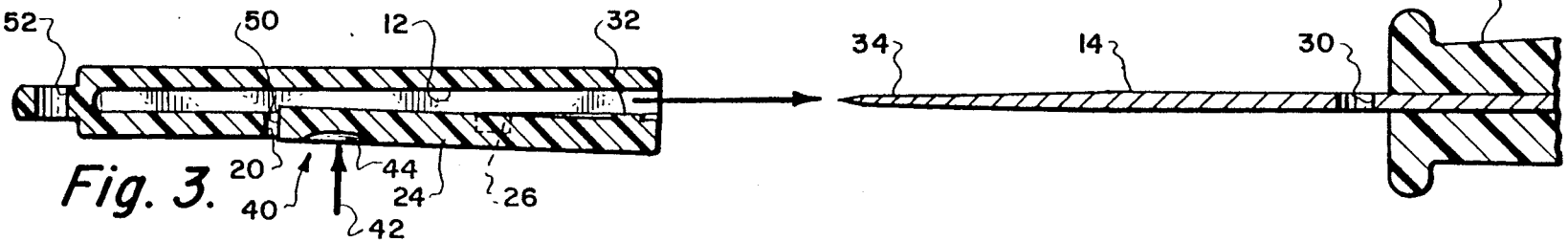
FIG. 3 is a sectional view similar to FIG. 2 but with the knife and sheath separated to better show the operation 10 of the release lever.

In FIG. 1 the knife and sheath combination of the present invention is shown with the blade fully covered by the sheath 10. In FIG. 3 the blade is withdrawn from the pocket 12 that is generally shaped to provide a snug fit to blade 14. The discussion herein refers simultaneously to all five figures. Sheath 10 is formed from a durable, tough, and resilient plastic such as ABS or the like. Sheath 10, includes a backside 16 that may be relieved to expose the blade 14 (not shown) and provide additional gripping surface to the sheath. The front side 18 is provided with openings 20 and 22, through which blade 14 is visible when sheathed, so as to leave a pivot lever 24 mostly detached from the sheath 10. However, small torsional hinges 26 remain to connect the central part of lever 24 to the sheath 10.

Figure 2:
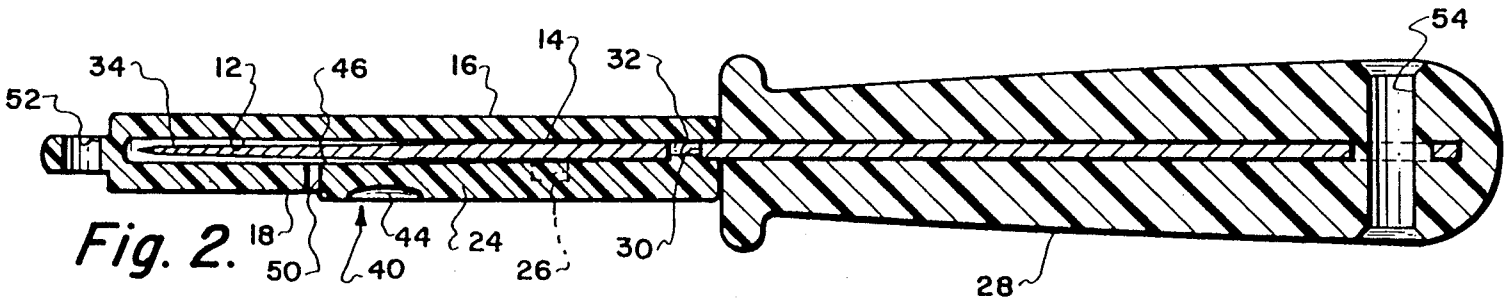
FIG. 2 is a sectional view of the inventive combination taken along section line 2—2 in FIG. 1.

In operation, lever 24 normally springs against blade 14 at the end nearest handle 28 as a consequence of the natural elasticity of the hinges 26. A hole 30 in blade 14 engages and locks to a locking pin 32 when blade 14 is fully inserted into pocket 12. Pin 32 does not block entry of blade 14 since the blade 14 is thinner at the tip 34 and, thus, slides past pin 32 causing pin 32 and lever 24 to pivot out of the way during insertion. But once fully inserted, with hole 30 coming into alignment with pin 32, the torsional spring of hinges 26 rotate lever 24 back into the position of FIG. 2 with pin 32 dropping into hole 30 to firmly hold the knife and sheath together.

To separate knife and sheath, one simply grasps the sheath 10 in a natural fashion, allowing a thumb or finger to engage the end of the lever at location 40 with a force diagramed by arrow 42 in FIG. 3. Pushing inward on end 40 rotates lever 24 about hinges 26 and withdraws pin 32 from hole 30 allowing quick and easy separation of the knife and sheath. Since the blade 14 grows thinner toward its tip, space 46 is available under end 40 of lever 24 to allow pivoting movement in the preferred embodiment. Additional space if needed, could be formed by removing material from the blade side of lever 24.

To enhance ease of operation, a small depression 44 is formed in lever 24 which allows a tactile sensation to guide the users finger to the proper location. Also, for smaller sheaths, the lever 24 may be shaped to be a bit higher than the surrounding sheath surface 18 as shown in the drawings, especially at location 50. This helps insure that compressional forces will flow mainly into lever 24.

Sheath 10 is provided, in the preferred embodiment, with a hole 52, in addition to the familiar hole 54 in handle 28 by which the knife can be carried in its sheath on a cord, key chain, or the like. The reliably tight grip of the sheath assures that the knife will not slip out during such transport.

If desired the sheath 10 could be constructed of separate plastic parts glued or welded together but the preferred embodiment contemplates injection molding the full structure in one step. For higher stress applications the sheath could even be made from metal or wood provided the cost could be justified. Hole 30 is formed all the way through blade 14 so as to allow blade 14 to be inserted into sheath 10 with either blade face against lever 24. Other modifications will be apparent to those skilled in the art that do not alter the scope of the invention and so I intend limitation only in accordance with the appended claims.

I claim:

1. A knife and sheath combination comprising:

a knife with a hole through the blade in a position proximate the handle;

a knife blade surrounding sheath means having a pocket adapted to receive the knife blade therein comprising a plastic structure with a back side adapted to fit adjacent one side of the knife blade and a front side adapted to fit adjacent the opposite side of the blade, said pocket being formed between said front and back sides;

lever means disposed in said sheath means and connected to said sheath means by hinge means located generally in the central portion of the lever means, said lever means positioned in the plane of the front side and connected to said front side by said hinge means, and said lever means including a guide recess in said remote end of said lever means; and engaging pin means on said lever means adapted to engage said hole in said knife when said knife is inserted into said pocket, said pin means being retractable from said hole by the compression of the lever means at the nd of the lever remote from said pin means so as to pivot the lever means about said hinge means.

2. The combination of claim 1 wherein said lever means rises above the plane of said front side to facilitate pressing said lever means.

3. A plastic knife sheath having a pocket adapted to receive the blade of a knife therein, a portion of the sheath on one side of the knife blade having openings therethrough so as to form a nearly detached lever portion connected to said sheath only by a pair of torsional hinge members extending between said lever portion and said sheath, said lever portion having a blade engaging protrusion at one end adapted to trap the knife blade in said pocket until the other end of the lever portion is pressed so as to pivot said lever portion about said hinge members to withdraw said protrusion from engagement with said blade.

4. The sheath of claim 3 including a guide recess in said other end of said lever portion.

5. The sheath of claim 4 in which said lever portion is thicker than said portion of the sheath on one side.

* * * * *